United States Patent [19]

Williams

[11] 4,176,486

[45] Dec. 4, 1979

[54] ADVERTISING DISPLAY

[76] Inventor: Lloyd Williams, 30 W. 86 St., New York, N.Y. 10024

[21] Appl. No.: 813,868

[22] Filed: Jul. 8, 1977

[51] Int. Cl.[2] ..... G09F 7/18

[52] U.S. Cl. ..... 40/607; 52/38; 248/228

[58] Field of Search ..... 40/607, 608, 606; 403/43–47; 52/38, 235, 483; 248/25.3, 226.1, 228

[56] References Cited

U.S. PATENT DOCUMENTS

| | | | |
|---|---|---|---|
| 2,595,352 | 5/1952 | Graham | 248/228 X |
| 2,746,451 | 5/1956 | Parker | 403/44 X |
| 2,816,783 | 12/1957 | Robertson | 403/44 |
| 3,998,028 | 12/1976 | Pelletier et al. | 248/228 |

FOREIGN PATENT DOCUMENTS

| | | | |
|---|---|---|---|
| 1106052 | 7/1955 | France | 40/607 |

*Primary Examiner*—John F. Pitrelli
*Attorney, Agent, or Firm*—Marvin Feldman; Stephen E. Feldman

[57] ABSTRACT

A display frame, which carries a sheet of mylar metalized to provide a mirror and an advertising display placard, is provided with a number of straps disposed for coaction with a turnbuckle type mounting device to securely position the display upon pillars of I-beam configuration such as those found in subway and train stations. The turnbuckle assembly of the mounting device is such as to exert compressive forces against opposed inner faces of the I-beam flanges and, in one embodiment, coacts with straps secured to the rear wall of the display to mount the display across the edges of said I-beam flanges so as to hide the mounting means in the space behind the display and between the flanges and web of the I-beam pillar.

The display frame is formed with one or more advertising placard mounting sections formed with grooves to facilitate positioning and easy removal of the placards which carry an advertising message. Such display sections in some embodiments are at an angle with respect to the mirror. A fluorescent lighting fixture, carried by some embodiments of display frames, is disposed behind the placard display section and for translucent placards to provide a back-light for the message.

10 Claims, 9 Drawing Figures

FIG. 2
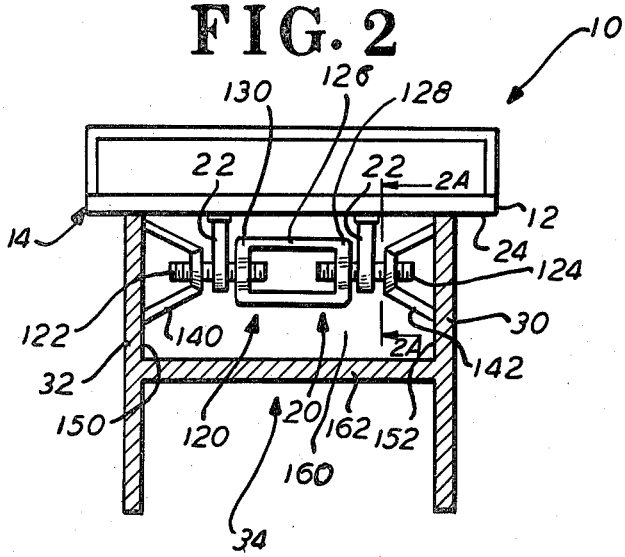
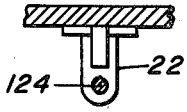
FIG. 2A
FIG. 3
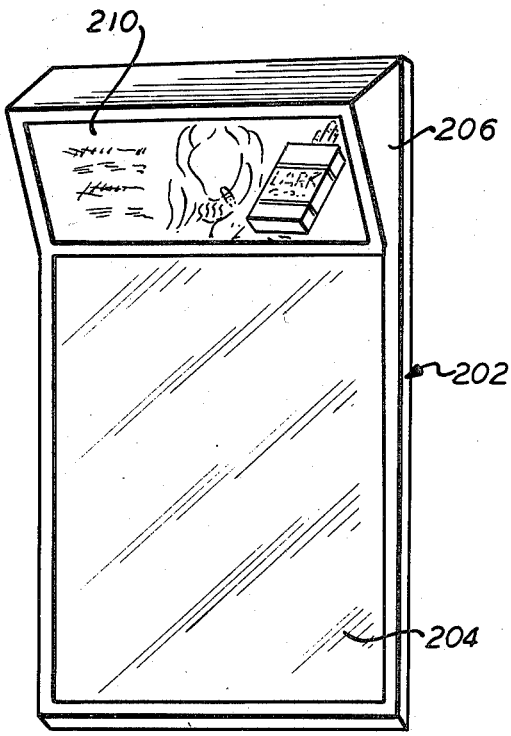
FIG. 4
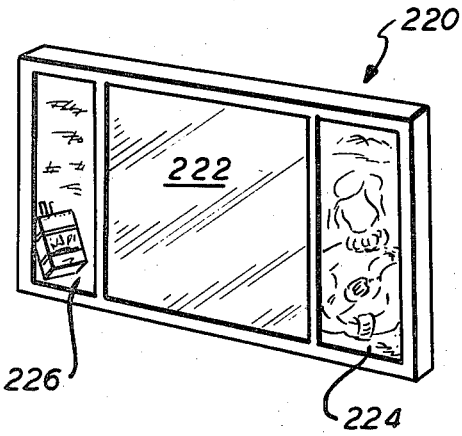
FIG. 6
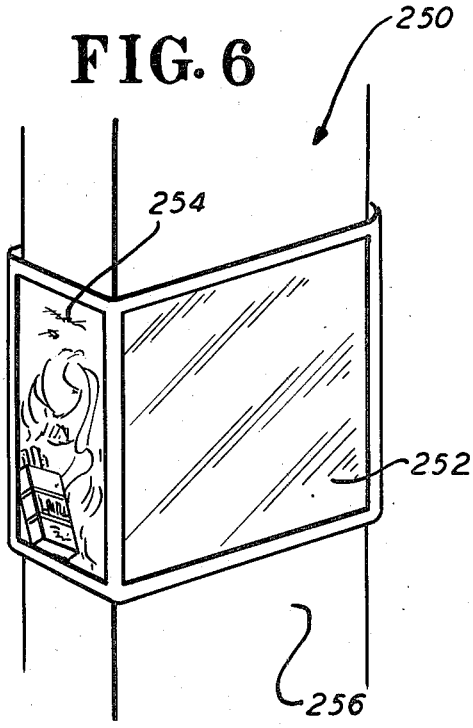

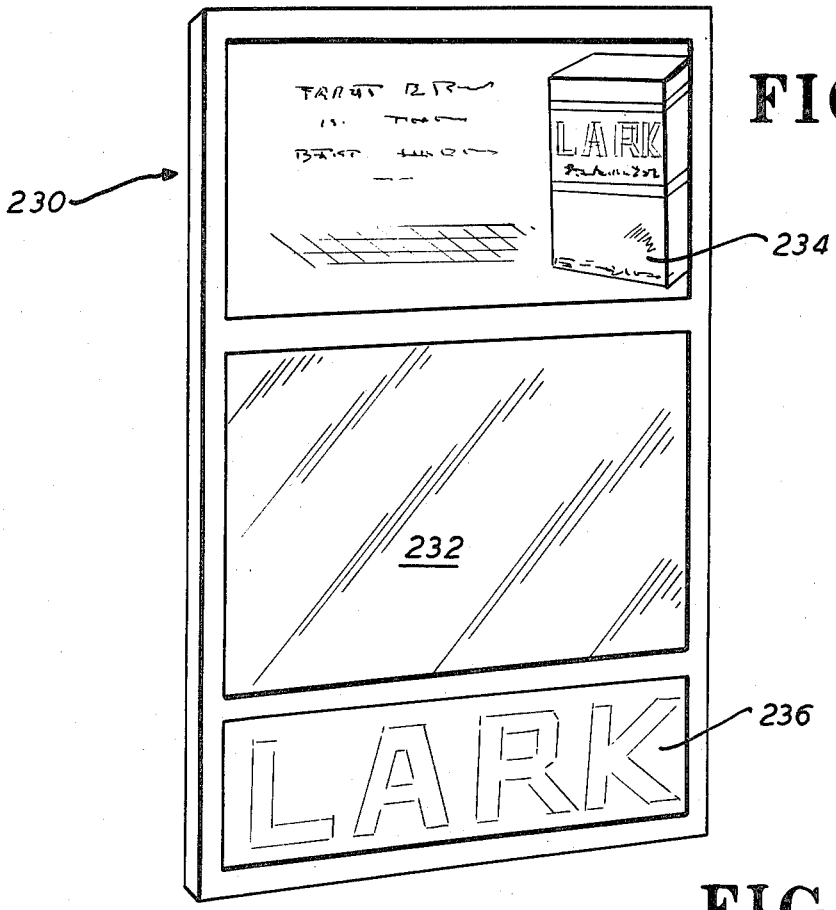
FIG. 5
FIG. 7
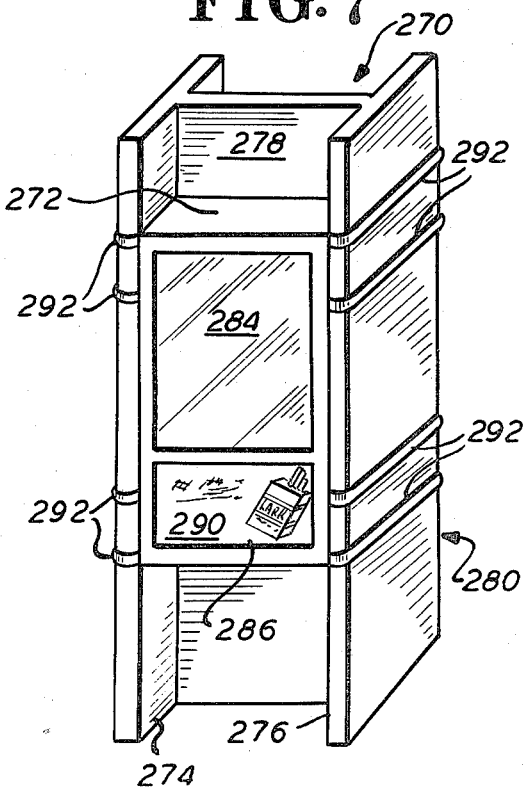
FIG. 8
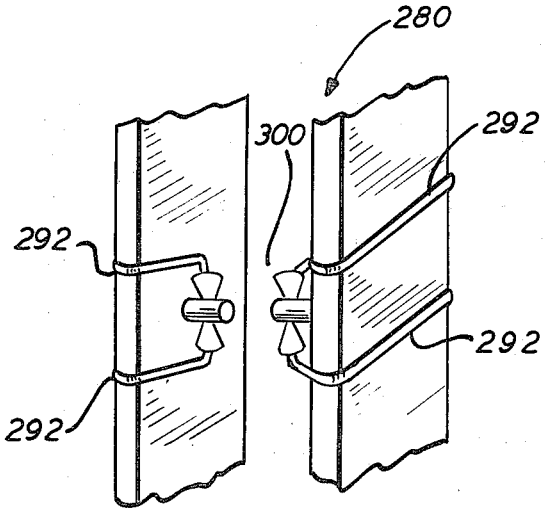

ADVERTISING DISPLAY

BACKGROUND OF THE INVENTION

1. Field of Application

This invention relates to displays for advertising; and more particularly to displays for positioning an advertising or other message upon pillars of I-beam configuration.

2. Description of Prior Art

A considerable portion of the population, especially in large cities, still use trains and subways. In doing so each member of the train and subway riding public spends sometime on or about the platform waiting for their train. As such they have time on their hands, and usually nothing else to do; so they are available to read messages if such are positioned for ready visual access. The advertising media, and business with products to advertise to the general public, have long realized this; and one generally finds the walls in and around the platform covered with advertisements. So much so that there is serious question as to whether the viewer is really attracted to any one advertisement enough so that its message is effectively conveyed.

In addition, some of the wall display positions are so large that only large and relatively expensive advertisements are acceptable by the party renting the space. For some products the expense of renting such a large space, and for making up the large advertising display required to fill the space, is not considered to be an efficient use of the advertising dollar.

At the same time smaller spaces, such as those upon the I-beam pillars which are so plentiful in train stations, are not being effectively used. These spaces are constantly in view of the public waiting to board trains; but are generally not utilized for lack of effective and efficient means for displaying a message thereon.

To merely past or otherwise stick a placard upon the pillar is too unattractive, and the display is subject to being easily ripped or torn off, by vandals and children with nothing better to do with their time. The only other item one might see upon the train platform pillars are vending machines for gum or candy. These are usually permanently fixed in place by bolts run through holes drilled through the pillars; an expensive securing method. Any message that might appear upon such vending machine, if any, usually is directed to the product being sold; and is usually ignored because of the display environment.

SUMMARY OF THE INVENTION

It is therefore an object of this invention to provide a new and improved display.

It is another object of this invention to provide a new and improved display for an advertising or other message.

It is still another object of this invention to provide a new and improved display for mounting upon pillars of I-beam configuration.

It is yet another object of this invention to provide a new and improved display for mounting upon I-beam pillars of train and subway stations.

It is yet still another object of this invention to provide a new and improved display which attractively mounts an unbreakable mirror and a message display positioned to be readily seen when using the mirror.

This invention involves displays for positioning messages, such as advertisements, for the public using trains to view; and contemplates associating the message portion of the display with a mirror carrying portion to better attract the viewer, and the mounting of such display upon the I-beam pillars in train stations by the use of compressive friction forces exerted against opposed inner faces of the I-beam flanges by turnbuckle assemblies which coact with straps carried by the display.

Other objects, features, and advantages of the invention in its detail of construction and arrangement of parts will be seen from the above, from the following description of the preferred embodiment when considered in conjunction with the drawings and from the appended claims.

BRIEF DESCRIPTION OF THE DRAWING

In the drawing:

FIG. 2 is a section taken on line 2—2 of FIG. 1 to better show details of the display mounting assembly;

FIG. 2A is a section on line 2A—2A of FIG. 1;

FIG. 3 shows a modified form of the display of FIGS. 1 and 2, and which incorporates the instant invention;

FIG. 4 shows still another modified form of the display of FIGS. 1 and 2, and incorporating the instant invention;

FIG. 5 shows yet another modified form of display incorporating the instant invention;

FIG. 6 shows yet still another modified from of display incorporating the instant invention;

FIG. 7 shows still a further modified display with a modified display mounting assembly; and FIG. 8 is a rear view of the display of FIG. 7, to better show details of the display mounting assembly therefor, wherein the I-beam web is not shown for clarity.

DESCRIPTION OF THE PREFERRED EMBODIMENT

Figure 1:
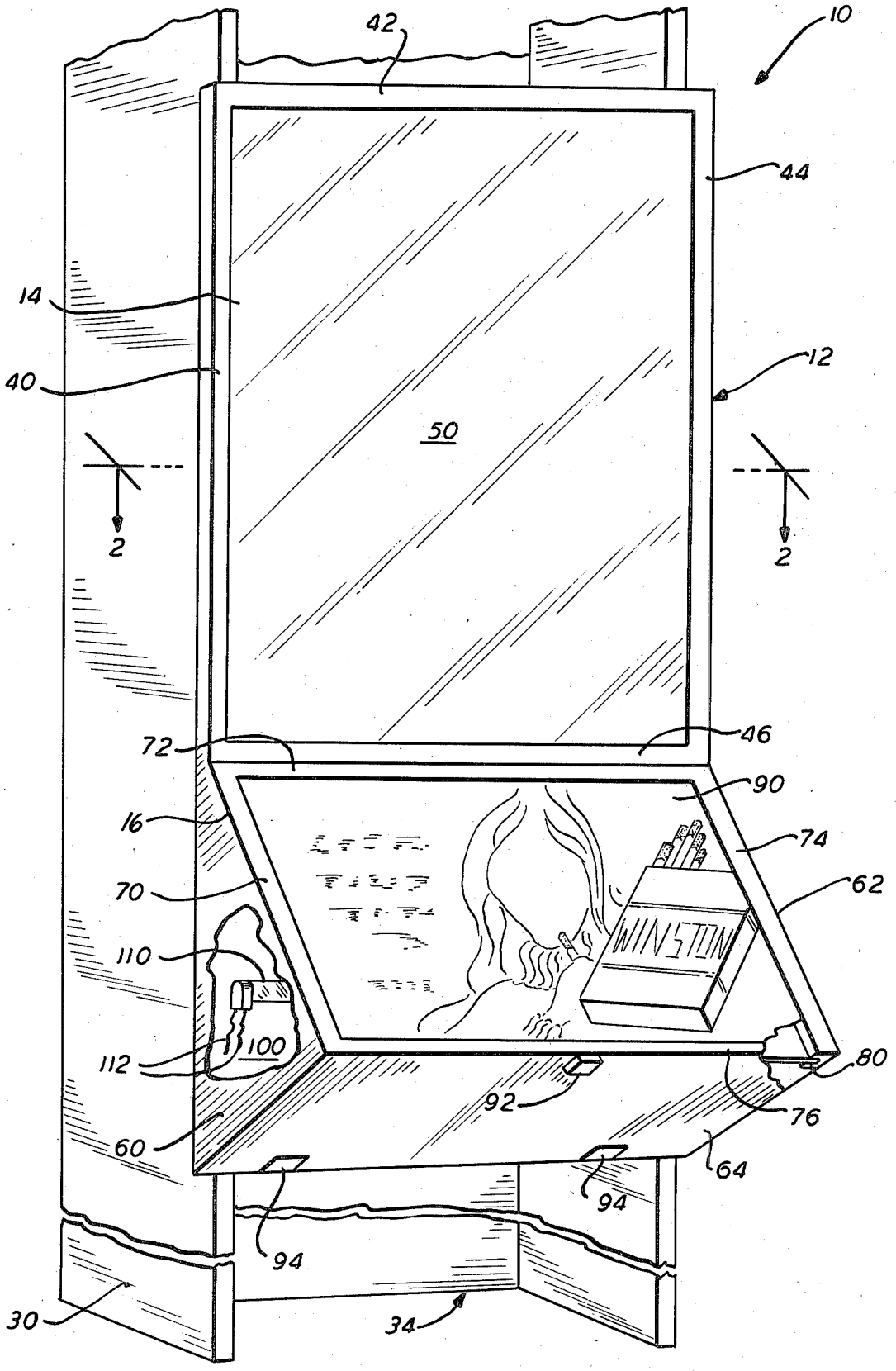
FIG. 1 is a perspective view of an I-beam pillar upon which a display, incorporating the instant invention, has been installed.

For convenience the invention will be described as applied to an advertising display for use in subway stations, to be mounted to I-beam pillars along the train platforms thereof, and formed with a display frame of extruded aluminum and which carries a mirror of metalized mylar sheet; it being understood nevertheless, that without departing from the scope of this invention, that the frame may be made of any convenient material and formed in any convenient manner, that the mirror may also be formed from convenient materials as long as it is non-breakable, that the display can be for other then advertising messages, and that the display can be affixed to any I-beam type post or pillar whether at the train platform, elsewhere within a train station or any place else where such pillars are used or can be positioned.

With reference to FIG. 1, there is generally shown at 10 a display including a frame 12 having a mirrored section 14 and a message section 16. A display mounting assembly 20 (FIG. 2) coacts with a pair of straps 22 secured to the rear wall 24 of display frame 12 and with the flanges 30, 32 of an I-beam pillar 34 to mount display 10 to pillar 34.

Frame 12 is formed from aluminum with extruded edge members 40, 42, 44 and 46, all secured to rear wall 24 so as to mount, in picture fashion, a mirror 50 formed from metalized mylar sheet or the like.

Message section 16 of frame 12 is formed with sides 60, 62 and a bottom panel 64 secured to rear wall 24; and with extruded aluminum edge members 70, 72, 74 and 76, secured in picture frame fashion thereto. Edge members 70, 72, 74 and 76, are notched or grooved, as shown at 80, to removably receive a display placard 90.

Placard 90 may be slid into grooves 80, or slid out of grooves 80, by merely releasing a latch 92, carried by bottom panel 64 and edge 76, and by rotating bottom panel 64 down about hinges 94 which attach bottom panel 64 to rear wall 24. Latch 92 may be provided with conventional locking means (such as a tumbler lock or a set of hasps and a lock) to prevent unauthorized access into a chamber 100 formed within the space between sides 60 and 62, bottom panel 64 and placard 90 when in place in edge members 70, 72, 74 and 76. If desired a light fixture 110, which may either be a fluorescent fixture, fixture for one of more incandescent bulbs, may be mounted within chamber 100. Electrical conductor means 112 extend from fixture 100 to appropriate power means (not shown) and are provided in circuit with switch and other control means to illuminate message section 16 of display 10. When so illuminated placard 90 should be of translucent material so that the illumination will enhance the message carried on placard 90.

Display mounting assembly 20 includes a turnbuckle assembly 120 having a pair of threaded rods 122, 124, appropriately threaded and carried by a center piece 126 with ends 128, 130 threaded to accommodate rods 124, 122 respectively and so that rotation of center piece 126 about rods 128, 130 will cause both rods to move either towards center piece 126 or away from center piece 126 depending upon the direction of rotation thereof. A foot assembly 140 is carried by rod 122 while a similar foot assembly 142 is carried by rod 124; both so as to permit movement thereof. Feet assembly 140, 142 are formed to respectively bear against opposed inner faces 150, 152 of flanges 32 and 30 respectively of I-beam 34.

Straps 22 of frame 12 are disposed thereon above the center of gravity thereof and so as to receive rods 122, 124 of mounting assembly 120. As such appropriate rotation of center piece 126 will move rods 122, 124 outwardly to force feet assembly 140, 142 against inner faces 150, 152. When sufficient compressive forces are created by such action the friction forces resulting between feet 140, 142 and faces 150, 152 will be such as to hold display 10 in position on pillar 34. In addition, display mounting assembly 120 is disposed within a channel 160 created by rear wall 24 of display 10, inner faces 150, 152 of I-beam 34 and central web 162 thereof. As such mounting assembly 120 is not in view of the public to detract from the attractiveness of the display; and to be tampered with by vandals.

It should be noted that message section 16 is disposed at an angle (approximately 30 degrees to the vertical) and in close proximity to mirror 50. This presents a pleasing environment wherein a viewer will be attracted to mirror 50 to use same and in doing so will readily see the message on placard 90.

Referring to FIG. 2A there is shown strap 22 with rod 124 disposed therein whereby frame 12 is held in place against I-beam pillar 34.

In the embodiment of FIG. 3, there is shown a display 200 with a frame 202 having a mirrored section 204 and a message display section 206, each similar in construction to sections 14 and 16 respectively of the embodiment of FIGS. 1 and 2. In this embodiment message section 206 is on top of mirrored section 204 with message placard 210 again disposed at 30 degrees to the vertical but upwardly and out from frame 202. Message section 206 may be illuminated as for the embodiment of FIGS. 1 and 2. The mounting assembly (not shown) for display 200 is also identical to that used for the embodiment of FIGS. 1 and 2.

In the embodiment of FIG. 4, there is shown a display 220 with a centrally disposed mirrored section 222, and a pair of message sections 224, 226 disposed one to each side of mirrored section 222; while in the embodiment of FIG. 5 the display 230 also includes a centrally disposed mirrored section 232 and a pair of message sections 234, 236 one above and one below mirrored section 232. The mounting of displays 200, and 230 are by means of mounting assemblies similar to assembly 120 for the embodiment of FIGS. 1 and 2.

In the embodiment of FIG. 6, there is shown a display 250 with a mirrored section 252 and a message section 254 that are adjacent each other and wrap about pillar 256. If desired, another mirrored section (not shown) and message section (not shown) may be provided. The mounting is by a turnbuckle assembly similar to 120 of FIGS. 1 and 2.

In the embodiment of FIGS. 7 and 8, there is shown a display 270 including a box-like frame 272 sized to fit between opposed flanges 274 and 276 and in front of web 278, of an I-beam pillar 280. A non-breakable mirror 284 is carried by display 270 on top of a message section 286 within which a message placard 290 may be removably mounted as described for the placard of FIGS. 1 and 2. Illuminating means (not shown) may be provided within frame 272 for back-lighting of placard 290.

Display 270 is mounted to I-beam pillar 280 by means of a plurality of straps 292 which coact with a turnbuckle 300, similar to turnbuckle 120, which coacts with straps 292 to securely mount display 270 to pillar 280.

As shown in FIG. 6 the turnbuckle 300 is accessed at the opposite or rear side of the I-beam in relation to the front or display side of the I-beam. In turning the turnbuckle the frame 272 is held in place against the I-beam pillar 280.

From the above description it will thus be seen that there has been provided a novel and improved display for advertising and like messages; which display is quite pleasing to the eye, attracts viewers to the message carried thereby by carrying a mirror, and is readily and securely attached to I-beam type pillars commonly found in train and subway stations and platforms.

It is understood that although I have shown the preferred form of my invention that various modifications may be made in the details thereof without departing from the spirit as comprehended from the following claims.

I claim:

1. A display for mounting upon pillars of I-beam cross-sectional configuration; comprising:

(a) frame means;

(b) message display means carried by said frame means;

(c) display mounting means coacting with said frame means to support same at a predetermined position upon pillar of I-beam cross-sectional configuration;

(d) said display mounting means including holding means operative to exert forces upon opposed inner faces of the flanges of the I-beam so as to securely lodge said display mounting means therebetween and so as to mount said display to the pillar.

2. The display of claim 1, wherein said frame means includes mirror mounting means mounting a mirror in close proximity to said message display means.

3. The display of claim 2, wherein said mirror mounting means mounts a non-breakable mirror.

4. The display of claim 1, wherein said message display means includes display mounting means for removably positioning a placard upon which a message is disposed.

5. The display of claim 4, wherein said message display means includes illuminating means disposed behind said placard for illuminating same and wherein the placard so illuminates is of translucent material.

6. The display of claim 5, wherein said illuminating means includes a fluorescent fixture.

7. The display of claim 4, wherein said message display is disposed on said frame means proximate mirror means.

8. The display of claim 7, wherein said message display means is disposed at an angle with respect to said mirror means.

9. The display of claim 8, wherein said message display is disposed on said frame means at a level which is lower than said mirror means.

10. The display of claim 1, wherein said mounting means includes strap means secured to a rear wall of said frame means, and wherein said holding means comprises turnbuckle assembly means including means which coact with said strap means in such a way as to secure said display to the pillar with said display mounting means hidden from ready view within a channel formed by the display and the flanges and web of the I-beam pillar.

* * * * *